United States Patent [19]

Ackert et al.

[11] Patent Number: 4,611,789

[45] Date of Patent: Sep. 16, 1986

[54] APPARATUS FOR THE PRODUCTION OF IMPROVED RAILWAY RAILS BY ACCELERATED COOLING IN LINE WITH THE PRODUCTION ROLLING MILL

[75] Inventors: Robert J. Ackert; Robert W. Witty; Peter A. Crozier, all of Sault Ste. Marie, Canada

[73] Assignee: The Algoma Steel Corporation Limited, Sault Ste. Marie, Canada

[21] Appl. No.: 675,772

[63] Division of Ser. No. 405,514, Aug. 5,1982, now Patent No. 4,486,248.

[22] Filed: Nov. 28, 1984

[30] Foreign Application Priority Data

Jul. 6, 1982 [CA] Canada ..... 406692

[51] Int. Cl.[4] ..... C21D 1/62

[52] U.S. Cl. ..... 266/81; 266/87; 266/90; 266/114; 266/117; 266/134

[58] Field of Search ..... 266/78, 80, 81, 87, 266/88, 90, 114, 117, 134, 259; 148/145, 146, 128

[56] References Cited

U.S. PATENT DOCUMENTS

| | | | |
|---|---|---|---|
| 1,752,646 | 7/1930 | Lukasczyk | 266/117 |
| 2,129,670 | 9/1938 | Brunner | 266/258 |
| 2,263,621 | 11/1941 | Frickey | 148/146 |
| 3,266,956 | 8/1966 | Bennewitz et al. | 148/146 |
| 3,276,924 | 10/1966 | Okamoto | 148/146 |
| 4,243,441 | 1/1981 | Wilson | 148/128 |

FOREIGN PATENT DOCUMENTS

| | | | |
|---|---|---|---|
| 1024422 | 1/1978 | Canada . | |
| 1220876 | 7/1966 | Fed. Rep. of Germany . | |
| 1583418 | 5/1972 | Fed. Rep. of Germany . | |
| 2439338 | 10/1975 | Fed. Rep. of Germany . | |
| 2109121 | 5/1972 | France . | |
| 3006695 | 8/1981 | German Democratic Rep. | 148/146 |
| 1151609 | 5/1969 | United Kingdom . | |
| 657883 | 4/1979 | U.S.S.R. | 148/146 |
| 256803 | 10/1983 | U.S.S.R. . | |

OTHER PUBLICATIONS

Babich, A. P. et al, "Strengthening Heat Treatment for Railroad Rails", Metallurgy, No. 12, pp. 29-31, Dec. 1978.

*Primary Examiner*—Christopher W. Brody
*Attorney, Agent, or Firm*—Merchant, Gould, Smith, Edell, Welter & Schmidt

[57] ABSTRACT

Railroad rails having improved wear resistance, are produced by controlled forced cooling from above the austenite transformation temperature, to produce rails having a fine pearlite metallurgical structure in the head portions of the rails. Apparatus comprising a series of cooling headers utilizing a liquid cooling medium, such as unheated (i.e., cold, or ambient temperature) water, alternating with a series of air zones, is preferably arranged in line with the production rolling mill, to receive hot rails as they emerge from the mill, without the necessity of intervening reheating. A roller type restraint system transports the rails through the cooling apparatus, while restraining them in the appropriate position. Each segment of the rail length is intermittently subjected to forced cooling by spray application of the liquid cooling medium, applied to the head portion, and the central portion of the base bottom, of the rail, with means being provided to prevent spray from impinging on the web and base tips of the rail. During the intervals between applications of forced cooling, heat soaks back from the web portion of the rail, the operating parameters of the system being so arranged that the temperature of the rail remains essentially above the martensite formation temperature. A computerized control system discontinues the application of forced cooling, at a predetermined stop temperature, also above the martensite formation temperature. The apparatus and method are capable of producing rails having the desired fine pearlite structure in the head portion, on a consistent basis, notwithstanding wide variations in temperature between different rails, and different segments of the same rail, as they emerge from a conventional production rolling mill.

14 Claims, 9 Drawing Figures

APPARATUS FOR THE PRODUCTION OF IMPROVED RAILWAY RAILS BY ACCELERATED COOLING IN LINE WITH THE PRODUCTION ROLLING MILL

This is a division of U.S. application Ser. No. 405,514, filed Aug. 5, 1982 now U.S. Pat. No. 4,486,248.

BACKGROUND OF THE INVENTION

1. Field of the Invention

This invention relates to an apparatus and a method for the manufacture of railway rails whereby improvements of rail physical properties and rates of manufacturing are achieved.

2. Description of Prior Art

Work conducted by various investigators throughout the 1970's and into the 1980's has demonstrated that steel railroad rails with a metallurgical structure composed of very finely spaced pearlite or a combination of very fine pearlite with a small volume fraction of bainite (sometimes referred to as transitional pearlite) give the best combination of physical properties (strength, hardness, toughness and wear resistance). See, for example, Smith, Y. E. and Fletcher, F. B., "Alloy Steels for High-Strength, As Rolled Rails", Rail Steels - Developments, Processing, and Use, ASTM STP 644, D. H. Stone and G. C. Knupp, Eds., American Society for Testing Materials, 1978, pp. 212–232; Heller, W. and Schweitzer, R., Railway Gazette International, October 1980, pp. 855–857; and Tamura, Y. et. al., "Development of the Heat Treatment of Rails", Nippon Kokan Technical Report, Overseas No. 29 (1980) pp. 10–20.

The inventors are aware of two methods currently in production to achieve these metallurgical structures, as described below.

(i) Method one involves reheating the rolled rail section from room temperature to a temperature above the ferrite to austenite transformation temperature and rapidly cooling the rail at a predetermined cooling rate. Tamura, et. al. mentioned above, and Hollworth, B. R. and R. K. Steele, "Feasibility Study of On Site Flame Hardening of Rail", American Society of Mechanical Engineers, 78-RT-8, teach different approaches to this art and both are successful in achieving the finely spaced pearlitic structure desired.

(ii) The second method involves alloying the standard carbon-manganese rail steels with elements such as chromium, molybdenum or higher levels of manganese, either singly or in various combinations, such that the metallurgical changes that take place during natural cooling after the hot rolling process result in the fine pearlitic structures desired. These types of rail steel may be further alloyed with such elements as silicon, vanadium, titanium and aluminum, either singularly or in various combinations to further improve properties by various mechanisms known to those skilled in the art of rail steel metallurgy.

The heat treatment method described above has the disadvantages of the costs of reheating, handling and time involved in the separate manufacturing process and all systems in commerical operation suffer from low productivity rates. The alloy method, while avoiding the disadvantages of the heat treatment method, is costly due to the requirements for expensive alloy additions.

It has been the dream of rail mill metallurgists since the early 1900's to achieve improved rail properties by the accelerated cooling of the rail as it leaves the hot rolling mill and various publications and patents have taught art concerning this approach. See, for example, Absalon, B. and Feszczenko-Czopiwski, J., "Production of Hardened Rails", Third International Meeting on Rails, Budapest 8-12.9.1935, Hungarian Association for Testing Materials, Budapest, 1936; Canadian Pat. No. 1,024,422, "Method of Treating Steel Rail", Bethlehem Steel Corporation (Robert J. Henry), Jan. 17, 1978; and Canadian Pat. No. 1,058,492, "Process for Heat Treatment of Steel", Fried. Krupp Huttenwerke A. G. (Wilhelm Heller), 17 July, 1979.

All early attempts at this approach, hereinafter referred to as "in-line heat treatment", failed to achieve a viable commercial manufacturing method due to the inability to consistently control the operation. Most of these methods were aimed at achieving preselected cooling rates such that the hot steel rail cooled to or near to room temperature with the cooling rate fixed at about 6° to 9° F./second in the temperature range of approximately 1400° to 1100° F.

It has been proposed to achieve the desired cooling rates using compressed air, steam, hot water and water modified with polymers. For example, Absalon et al., and Canadian Pat. No. 1,024,422, mentioned above, refer to the use of steam and hot water.

The direct use of unheated water has resulted in overcooling the surface region of the rail, causing the formation of martensite. Each of these controlled cooling rate methods offers its own advantages but a common disadvantage is the difficulty of maintaining the necessary constant conditions in the production facilities required to achieve the critical cooling rates. Indeed, the variation in temperature from rail to rail plus the variations in temperature along the length of the rail as it leaves the hot rolling mill cause the temperature at the start of the cooling process to vary as much as ±100° F. from the aim starting point. This fact alone means that no suggested constant cooling rate process known to the applicants, can be applied to conventional rail mills presently in operation.

In some approaches, attempts were made at achieving a more wear resistant rail by quickly cooling the rail surface directly after rolling to a temperature below the martensite start temperature and then allowing the core heat to soak back to the surface to temper the martensite. The resultant metallurgical structure is called sorbite (self-tempered martensite is also a term commonly used) and is the object of the Neuves-Maison method and variations of it referred to by Absolon et. al. Although this approach was successful in achieving a hard, wear resistant surface, the shell of sorbite over a core of pearlite resulted in metal fatigue at the sorbite-pearlite interface due to the abrupt change in material hardness. This fatigue becomes critical with heavily loaded wheels on modern trains and results in sudden, catastrophic rail failure. Modern rail steel metallurgists recognize the need to have a graded metallurgical structure such that there are no sudden changes in material hardness (see, for example, Nippon Kokan Technical Report, Overseas, N29(1980) referred to above).

SUMMARY OF THE INVENTION

The present invention provides a method and apparatus for the production of improved railroad rails, having improved wear resistance. Persons skilled in the art will understand that, with the advent of heavier trains and higher speeds, rail wear is becoming an increasingly serious problem, and that in the current economic climate, the costs and disruptions of service associated with the replacement of worn rails, are becoming increasingly objectionable, leading to a demand on the part of the railroad industry, for rails having better wear resistance than conventional rails presently in use. To be commercially acceptable, such improved rails must, of course, be cost-competitive, and the cost penalties associated with technically successful prior art attempts to produce more wear-resistant rails, limit their usage.

It will also be understood that the part of a rail which is most subject to wear, is the head portion, particularly the top and inner side surfaces of the head portion. To provide a rail having improved wear resistance, it is therefore desirable for the head portion of the rail, or at least the near-surface region of the head portion, to have a metallurgical structure composed of very finely spaced pearlite, or a combination of very fine pearlite with a small volume fraction of bainite (sometimes referred to as transitional pearlite).

In accordance with the present invention, rails having this desirable property are produced by an in-line heat treatment wherein the hot rails, upon exit from the rolling mills, subjected to intermittent periods of forced cooling, by spray application of a liquid cooling medium, typically unheated (i.e. ambient temperature) water. Means are provided to confine the application of the coolant to the head portion and the central portion of the bottom of the base (but not the tips of the base) of the rail. During the intervals between the application of coolant, heat soaks back into the cooled regions, from other portions of the rail section, particularly the rail web, which is not subjected to the application of coolant. The operational parameters of the cooling process are so regulated, as to prevent over cooling of the near surface regions of the rail, whereby the formation of martensite is avoided, and the desired metallurgical structure is produced. While the primary object is to provide the desired metallurgical structure in the head portion of the rail, it has been found advantageous to simultaneously apply intermittent cooling to the bottom of the base portion of the rail, with a view to minimizing camber, i.e. bending of the rail due to differential thermal contraction and metallurgical reactions. Application of coolant to the tip portions of the base of the rail is avoided, because these portions are of relatively small section, creating a risk of over-cooling and formation of martensite, if coolant were applied thereto.

Apparatus for performing this heat treatment method, in accordance with the present invention, comprises a roller restraint system in line with the production rolling mill, which receives rails from the mill, and conveys them through the series of alternating coolant headers and air zones. The headers include means for spraying coolant onto the rail as it passes through, and means such as a system of baffles for confining the application of the coolant to the desired portion of the rail, namely the head portion and the central region of the bottom of the base. The air zones which alternate with the headers, are preferably enclosed, with a view to minimizing the effect on the process, of substantial variations which may occur in the ambient air temperature in the mill.

The spraying means may comprise nozzles for conventional spray application of coolant, or alternatively, means for producing a "liquid curtain" through which the rails pass. "Liquid curtains" or "water curtains" are known in the art, and may be regarded as a specialized form of spraying. In the present specification and claims, the terms "spray" and "spraying" are to be understood as including both conventional spraying and the "liquid curtain" technique.

The method herein described is much easier to control than methods heretofore suggested and the embodiment of the apparatus of the invention, herinafter described, incorporates a control system that is much more accurate than heretofore described in known literature or patents issued. The present invention achieves these advantages whilst maintaining high rates of production and whilst adding little, if anything, to the alloy costs of the steel generally utilized in standard rail production. Other objects and advantages of the present invention will become apparent in the detailed description of embodiments of the invention, accompanying drawings and claims which follow.

DESCRIPTION OF THE PREFERRED EMBODIMENT

A better understanding of the present invention may be had by reference to the following description of the presently preferred embodiment, taken in connection with the drawings.

Figure 1:
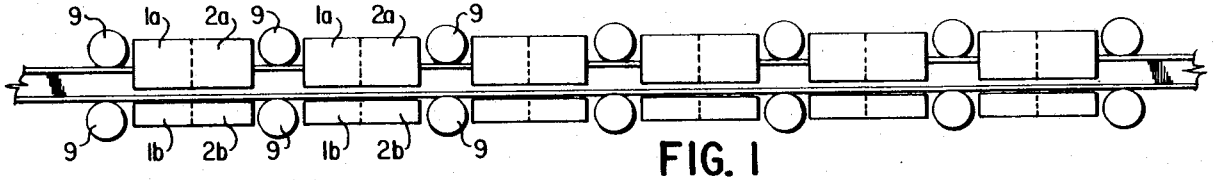
FIG. 1 is a side elevation view of apparatus of the present invention.
Figure 2:
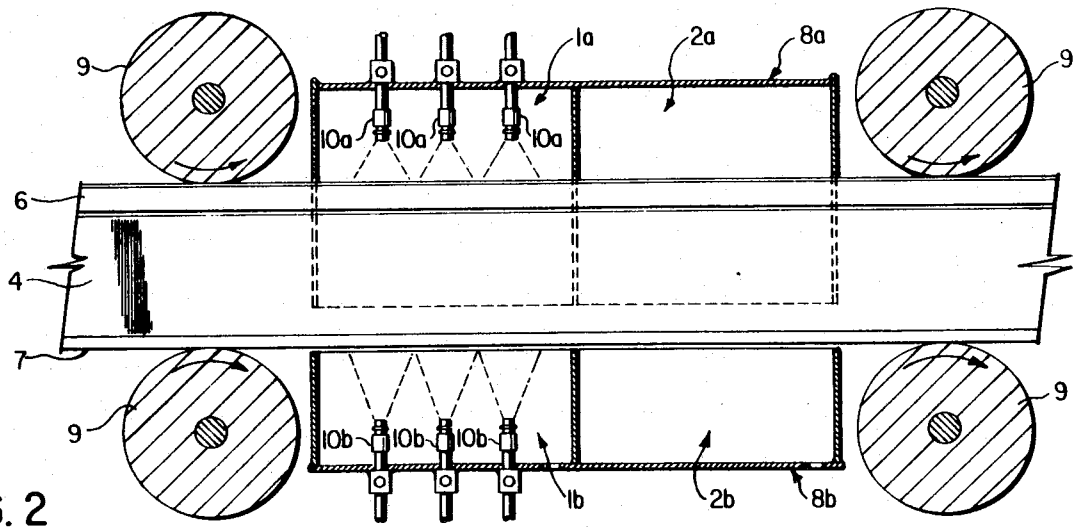
FIG. 2 is a side elevation, in section and larger scale, of a portion of the apparatus of FIG. 1.
Figure 3:
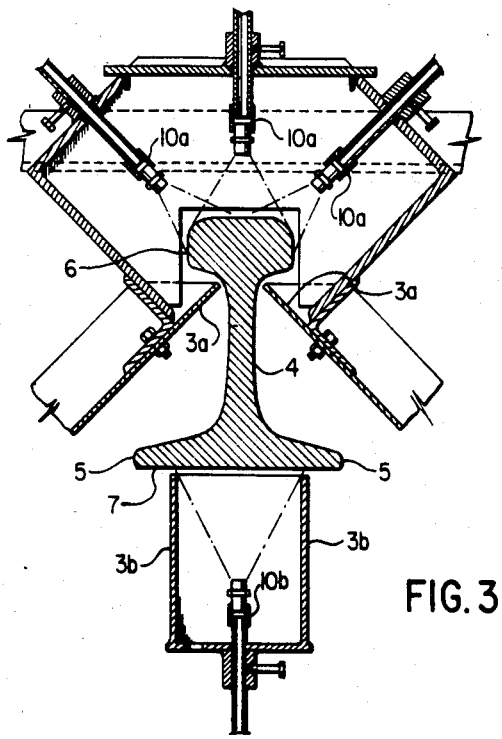
FIG. 3 is a cross-section view through a water spray zone to show the placement of the baffles, in the apparatus of FIGS. 1 and 2.

Apparatus for in-line accelerated cooling of railroad rails after hot rolling in accordance with the present invention, is illustrated in FIGS. 1 to 3.

Referring to FIG. 1, the apparatus comprises a roller type restraining system, comprising a plurality of rollers 9, designed to transport the rail in the longitudinal direction through the spray headers and air zones, whilst keeping the rail at its required position with respect to the sprays, and restraining the rail from distortion due to uneven thermal contraction. A plurality of low pressure water spray headers, 1*a* and 1*b*, alternate with a plurality of shrouded air zones, 2*a* and 2*b*.

Referring now to FIGS. 2 and 3, each spray header comprises a plurality of nozzle assemblies 10*a*, arranged to spray cooling water on the head portion 6 of the rail, and a plurality of nozzle assemblies 10*b*, arranged tg spray cooling water against the central portion of the base bottom 7 of the rail. Inclined baffles 3*a* are provided, to prevent any spray from nozzle assemblies 10*a*, from reaching rail web 4, and to prevent any drip from the sides of rail head 6, from falling on the upper surfaces of the rail base. Vertical lower baffles 3*b*, confine the spray from nozzle assemblies 10*b* to the central portion of rail base bottom 7, preventing any portion of this spray from reaching base tips 5.

Air zones 2*a* and 2*b* are surrounded by close-coupled shrouds 8*a* and 8*b* to minimize fluctuations in air cooling due to any sudden changes in ambient conditions.

Nozzle assemblies 10*a* and 10*b* are connected to a suitable source of pressurized unheated (i.e. "cold" or ambient temperature) water.

A computer-based control system with associated entry and exit temperature monitoring systems (not shown) is utilized to control the operation of the system.

The operation of the apparatus, in carrying out the method of the present invention, will now be described.

As the rail is transported through the cooling system in the head up position, the head 6 and base bottom 7 are intermittently cooled by the water sprays in such a manner that heat soak-back during its passage through the alternating air zones is sufficient to keep the near surface region of the rail essentially above the martensite formation temperature. Subject to this constraint, the rail head is cooled as quickly as possible until it reaches a predetermined cooling stop temperature. At this point, the water sprays are turned off and the rail is allowed to cool in air.

Keeping the water off the web section of the rail serves the following purposes.

(i) The heat soak-back from the hot web 4 into the cooled head 6 modifies the cooling characteristics of the head such that, after the cessation of water spray cooling, the head remains at a near constant temperature for a period of time.

(ii) The hot web and cooled base bottom 7 help to keep the rail straight during forced cooling.

(iii) The heat distribution minimizes harmful residual stresses during subsequent final cooling.

Figure 4:
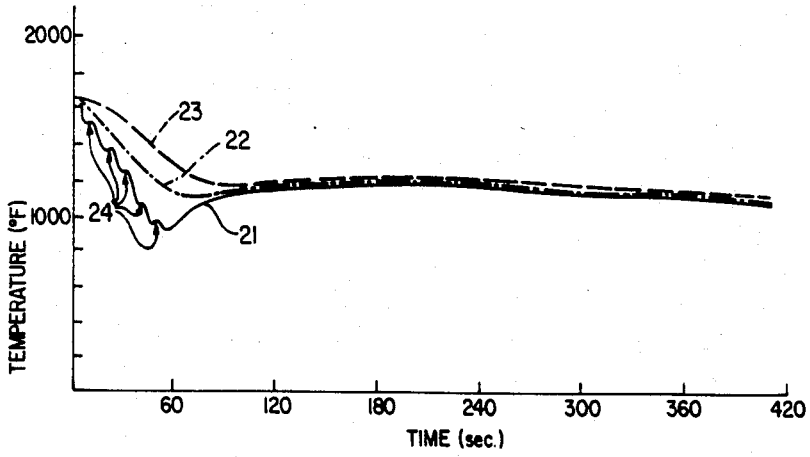
FIG. 4 shows the time-temperature cooling curves measured by placing thermocouples 1 mm, 10 mm and 20 mm below the running surface of the rail and cooling it from 1700° F. in the manner herein described.

Experimentation has shown that the heat from the web section of the rail soaks into the force cooled head after cessation of cooling at a rate that approximately offsets the air cooling of that region. As a result, the time-temperature curve for the rail head has an approximately flat region for six minutes or more after the termination of the water cooling. FIG. 4 illustrates time-temperature cooling curve measured by implanting thermocouples 1 mm, 10 mm and 20 mm below the running surface of a rail section and cooling it in an experimental apparatus in the manner herein described, and demonstrates the effectiveness of this approach. Curves 21, 22 and 23 represent the values at the 1 mm, 10 mm and 20 mm positions, respectively. Steps 24 in curve 21, of course, represent the heat soak-back stages between spray headers.

Figure 5:
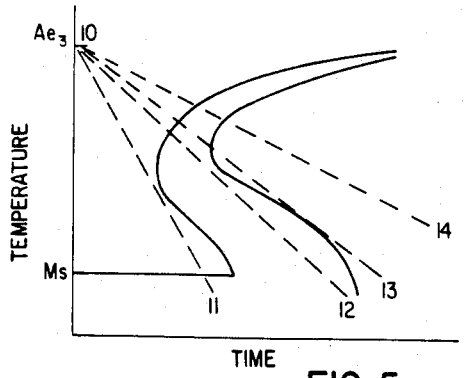
FIG. 5 is a graphical representation of the prior art method of cooling.
Figure 6:
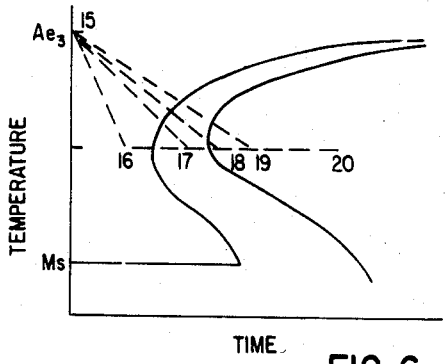
FIG. 6 is a graphical representation of the cooling approach achieved in the present invention.

FIGS. 5 and 6 graphically compare the cooling approach taught in the previously mentioned prior art with that achieved in the present invention. The continuous cooling transformation curves shown in FIGS. 5 and 6 are well understood by those skilled in the art of rail steel metallurgy. In the prior art methods the slope of the cooling curve from the Ae3 temperature to the transformation start temperature is critical and must be controlled within very tight tolerances in order to avoid the formation of martensite or large volume fractions of bainite while still achieving the desired fine pearlite. In FIG. 5, cooling described by line 10-11 would result in the formation of martensite. Cooling along line 10-12 results in large volume fraction of bainite. Cooling in the region bounded by lines 10-13 and 10-14 results in the desired fine pearlite. Cooling at rates slower than described by line 10-14 results in deterioration of rail physical properties due to increasingly coarse pearlite being formed. By the method of the present invention, cooling from above the austenite to ferrite transformation temperature anywhere in the region bounded by lines 15-16-20 and 15-19-20 in FIG. 6 achieves the desired fine pearlite. The effect of varying the cooling stop temperature is shown in the examples given below. The right most nose shaped curve of FIG. 6 defines the locus of temperatures and times at which 95% of the austenite to pearlite transformatin is complete. Termination of the application of the liquid cooling medium at a time before (i.e., to the left of the right most curve of FIG. 6) the right most nose shaped curve of FIG. 6 means that forced cooling ceases before the completion of the austenite to pearlite transformation.

The forced cooling of the rail base bottom is designed to help keep the rail straight within the roller restraining system by approximately balancing thermal contraction and stresses associated with metallurgical transformations top to bottom during forced cooling. In addition the hot web is above the stress relieving temperature and, therefore, induced stresses will be released immediately.

In order to demonstrate the effectiveness of the bottom cooling in minimizing distortion during forced cooling, an experimental apparatus was built to force cool an unrestrained rail by the method herein described. When the head only was force cooled, the rail distorted with a camber ratio of 0.012. When the head and base bottom were force cooled, the camber ratio was less than 0.0009.

The base tips, 5, are kept as hot as possible during the forced cooling in order to prevent over-cooling these areas which could cause the formation of martensite.

The close coupled shrouds 8 and 8*a* around the rail in the air cooling zones help prevent convective heat loss and prevent unpredictable changes in the ambient conditions around the rail. They are designed to help stabilize the characteristics of the time-temperature cooling curve discussed above and illustrated in FIG. 4 during the heat soak-back stages, represented by steps 24 in curve 21 of FIG. 4, between water headers.

The roller type restraining system is designed to transport the rail in a head-up position through the water sprays and air zones. It is designed to compensate for the camber that cannot be corrected by the top and bottom cooling and it keeps the rail in the proper location with respect to the water spray nozzles and baffles within the spray headers. The detailed design of the roller restraining system would be obvious to those skilled in the art of mechanical engineering and therefore will not be further described herein.

The computer-based process control system is designed to monitor the rail head temperature as it enters the first water spray header and to automatically adjust the process to compensate for the temperature variation betweeen rails and within the length of any particular rail in order to achieve the desired constant stop temperature.

In experiments to date, the process adjustment made for temperature compensation purposes has been the number of water spray headers used to cool each rail segment. However, it is obvious that the linear velocity of the rail through the spray zones or the cooling effectiveness of the spray headers also could be used, either singularly or in various combinations, as control variables. The detailed design of the computer-based process control used is not contained herein because those skilled in the art of process control could readily build various such systems to meet the purposes of the present invention. However, it is important to note that, in the present invention, the wider variation of acceptable cooling rates in contrast to all prior art methods enables the operation to be controlled in a practical commerical operation in the manner herein described.

EXAMPLES

The present invention will be further illustrated by way of the following examples.

EXAMPLE #1 —Test Results

Lengths of standard 136 lb. per yard railroad rails with the chemical composition shown in Table I were force cooled by the method herein disclosed with varying cooling stop temperatures in the range of 850° to 1200° F.

TABLE I

| Element | Amount (Weight Percent) |
|---|---|
| Carbon | .75 |
| Manganese | .95 |
| Sulphur | .020 |
| Phosphorus | .010 |
| Silicon | .25 |
| Balance | Iron and Incidental Impurities |

Figure 7:
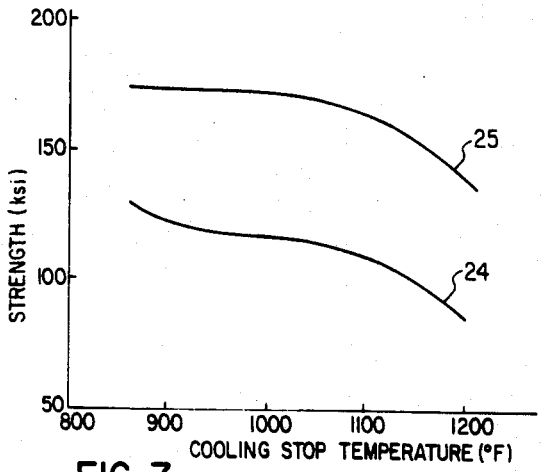
FIG. 7 shows graphically the correlation between the cooling stop temperature and yield strength (curve 24) and ultimate tensile strength (curve 25).
Figure 8:
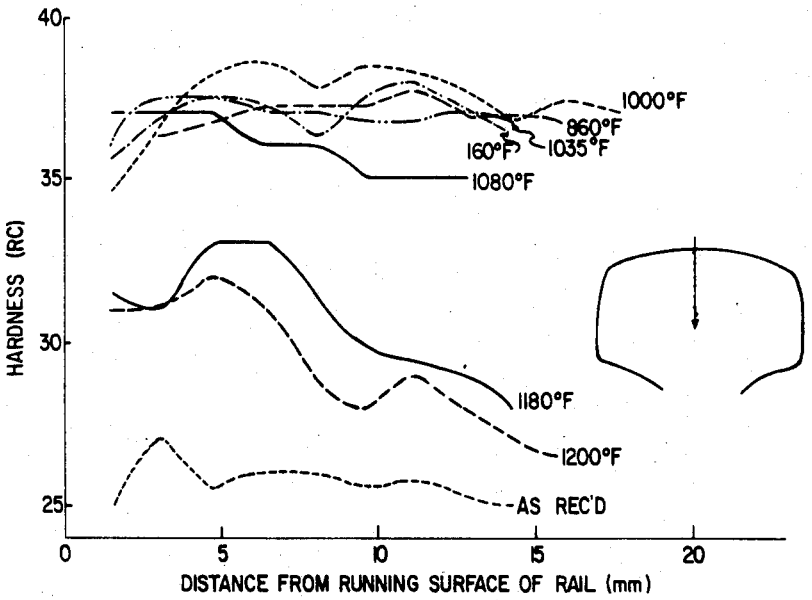
FIG. 8 shows graphically the hardness profiles measured from the centre of the running surface achieved with various cooling stop temperatures.
Figure 9:
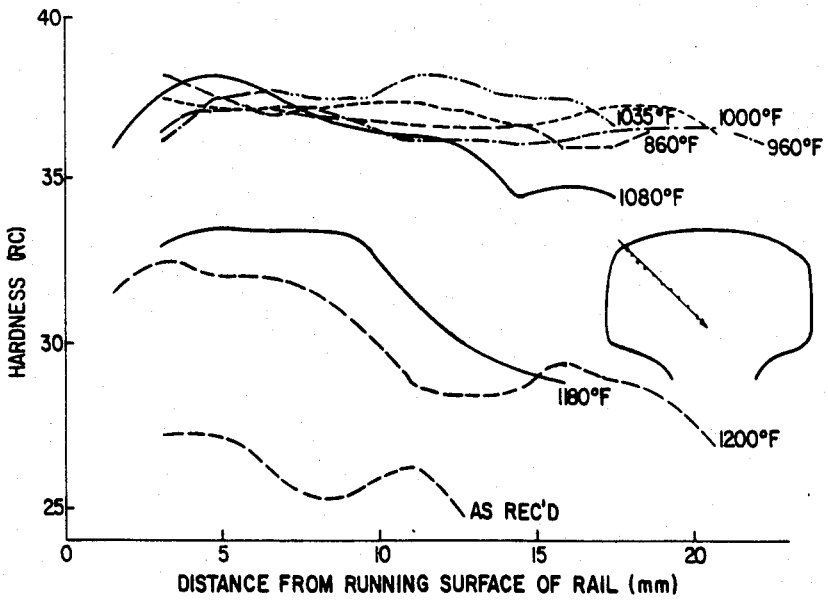
FIG. 9 shows graphically the hardness profiles measured from the top corner of the rail head achieved with various cooling stop temperatures.

FIG. 7 shows the correlation achieved between the cooling stop temperature and strength. FIGS. 8 and 9 show hardness profiles achieved as functions of distance from the running surfaces of the rail head and cooling stop temperatures.

Metallographic examination revealed that the transformation structures were finely spaced pearlite and/or transitional pearlite with cooling stop temperatures as low as 850° F. and even lower in some cases. No evidence of martensitic transformations were found and bainite was formed only when the rails were deliberately taken to lower cooling stop temperatures.

EXAMPLE #2 Computer Based Control System

A computer based control system appropriate to the process herein disclosed may comprise the following elements:

(i) A temperature monitoring device such as a pyrometer at the entry end of the cooling apparatus.

(ii) A temperature monitoring device such as a pyrometer at the exit end of the cooling apparatus.

(iii) A digital, electronic computer with associated memory and computational elements.

(iv) Electrically operated water valves on all cooling headers.

(v) Interface hardware to link the temperature sensing devices and electrically operated water valves to the computer.

(vi) Computer programming that can automatically monitor incoming temperature information and regulate the number of cooling headers in operation at any time by activating the water valves.

(vii) Information readout equipment such as a cathode ray tube.

The programming within the computer contains thermodynamic data, heat transfer information characterizing the cooling equipment and allowable process tolerances. When the temperature of the incoming rail is sensed, the computer automatically activates the correct number of coolant headers required to achieve the desired cooling stop temperature.

The temperature of the exiting rail is sensed and relayed to the computer which compares it to the desired temperature. If the achieved temperature deviates from the desired temperatures by more than the programmed process tolerance, the computer signals the operating personnel via the cathode ray tube so that appropriate action can be taken (i.e. rail rejected or reapplied to a less critical order). The computer automatically makes adjustments within its programming so that the temperature error is corrected in the next rail processed. (Note: The error could be due to events not detectable by the computing system such as clogged headers and operating personnel would be signalled to take corrective maintenance action).

In operation, the temperature of each segment of incoming rail is sensed and the number of header used is varied as the rail progresses through the system to compensate for incoming temperature variation along the length of the rail so that each segment of rail is cooled within tolerance to the desired cooling stop temperature.

Since many changes could be made in the above disclosed method and many apparently widely different embodiments of this invention could be made without departing from the scope thereof, it is intended that all matter contained in the above description, shown in the accompanying drawing and contained in the example shall be interpreted as being illustrative only and not limiting. Changes that could be made include, but are not limited to, significant changes in rail steel chemistry and in starting with a cold rail, reheating it to an appropriate temperature and then force cooling it by the method herein disclosed. An additional change that could be in to place the rail in a slow cooling tank ("Maki tank") after forced cooling, if necessary, in order to allow residual hydrogen left from the steelmaking operation to diffuse harmlessly out of the metal.

The embodiments of the invention in which an exclusive property or privilege is claimed are defined as follows:

1. Apparatus for accelerated cooling of a railroad rail passing longitudinally through said apparatus from an initial temperature above the austenite to ferrite transformation temperature, to improve the metallurgical properties thereof by producing a metallurgical structure composed primarily of finely spaced pearlite in the rail head of the railroad rails, comprising:

(a) means for subjecting the head portion and the bottom surface of the base portion of the rail to intermittent forced cooling, in such a manner that the near surface region of the rail is maintained essentially above the martensite transformation temperature, said means comprising a series of cooling headers longitudinally spaced from one another by passive air zones of selected lengths, the cooling headers being operable to apply a liquid cooling medium to the rail thereby to afford a relatively high rate of cooling of the rail as it passes each of the cooling headers, the passive air zones being free of applied fluid thereby controlling the rate of cooling of said rail to a relatively low figure as it passes through each of the passive air zones;

(b) first baffle means for minimizing the cooling of the web portion and the top and side surfaces of tips of the base portion of the rail during the intermittent forced cooling;

(c) second baffle means for minimizing the cooling of the bottom surface of the tips of the base portion of the rail during the intermittent forced cooling;

(d) transport means for passing the rail longitudinally along the series of cooling headers and air zones such that the head portion and base bottom portion of the rail may be subjected to the liquid cooling medium; and (e) control means for terminating the application of the liquid cooling medium when the head portion of the rail has reached a predetermined cooling stop temperature in the range of 850° F. to 1200° F., the control means including temperature monitoring means at the entry and exit ends of the apparatus.

2. The apparatus of claim 1, wherein the cooling headers include head spraying means for spraying the liquid cooling medium on to the head portion of the rail and base spraying means for spraying the liquid cooling medium on to a central part of the bottom surface of the base portion of the rail.

3. The apparatus of claim 1, wherein the transport means comprises a roller type restraining system operable to transport a rail longitudinally along the series of cooling headers and air zones in a head-up position while restraining the rail against thermal distortion.

4. The apparatus of claim 2, wherein the second baffle means comprises a pair of baffles extending downwardly from locations adjacent to the bottom surface of the base portion of the rail, spaced laterally to each side of the center line of the base portion, for preventing spray directed at the central part of the bottom surface of the base portion from impinging on the tips of the base portion.

5. The apparatus of claim 4, wherein the first baffle means comprises a pair of inclined baffles associated with each cooling header, extending outwardly and downwardly from locations adjacent each side of the top of the web portion of a rail being transported, below the head portion of the rail, for preventing spray directed at the head portion of the rail from impinging upon the web portion and upon the top and side surfaces of the tips of the base portion of the rail.

6. The apparatus of claim 1, wherein the control means additionally comprises a control system operatively connected to the temperature monitoring means for regulating the operation of the apparatus in response to entry and exit temperature information received from the temperature monitoring means.

7. The apparatus of claim 1, wherein the passive air zones are enclosed by close-coupled shrouds for minimizing the effect of fluctuations in ambient air conditions.

8. Apparatus for accelerated cooling of a railroad rail passing longitudinally through said apparatus from an initial temperature above the austenite to ferrite transformation temperature, to improve the metallurgical properties thereof by producing a metallurgical structure composed primarily of finely spaced pearlite in the rail head of the rails, comprising:

(a) means for subjecting the head portion of a rail to intermittent forced cooling, in such a manner that the near surface region of the rail is maintained essentially above the martensite transformation temperature, said means comprising a series of cooling headers longitudinally spaced from one another by passive air zones of selected lengths, the cooling headers being operable to apply a liquid cooling medium to the rail thereby to afford a relatively high rate of cooling of the rail as it passes each of the cooling headers, the passive air zones being free of applied fluid thereby controlling the rate of cooling of said rail to a relatively low figure as it passes through each of the passive air zones;

(b) means for minimizing the cooling of the web portion and the tips of the base portion of the rail during the intermittent forced cooling;

(c) transport means for passing the rail longitudinally along the series of cooling headers and air zones such that the head portion and base bottom portin of the rail may be subjected to the liquid cooling medium; and (d) control means for terminating the appliction of the liquid cooling m edium when the head portion of the rail has reaches a predetermined cooling stop temperature in the range 850° F. to 1200° F., the control means including temperature monitoring means at the entry and exit ends of the apparatus.

9. The apparatus of claim 8, wherein the means for minimizing the cooling of the web portion and the tips of the base portion comprise confining means for confining spray from the spraying means to the head portion.

10. The apparatus of claim 8, wherein the cooling headers include spraying means for spraying the liquid cooling medium on to the head portion of the rail.

11. The apparatus of claim 9, wherein the confining means comprises a pair of inclined baffles associated with each cooling header, extending outwardly and downwardly from locations adjacent each side of the top of the web portion of a rail being transported, below the head portion of the rail, for preventing spray directed at the head portion from impinging upon the web portion and upon the tips of the base portion of the rail.

12. The apparatus of claim 8, wherein the transport means comprises a roller type restraining system operable to transport a rail longitudinally along the series of cooling headers and air zones in a head-up position while restraining the rail against thermal distortion.

13. The apparatus of claim 8, wherein the control means additionally comprises a control system operatively connected to the temperature monitoring means for regulating the operation of the apparatus n response to entry and exit temperature information received from the temperature monitoring means.

14. Apparatus for accelerated cooling of a railroad rail passing longitudinally through said apparatus from an initial temperature above the austenite to ferrite transformation temperature, to improve the metallurgical properties thereof by producing a metallurgical structure composed primarily of finely spaced pearlite in the rail head of te rails, comprising:

(a) means for subjecting the head portion of a rail to intermittent forced cooling, the such a manner that the near surface region of the rail is maintained essentially above the martensite transformation temperature, said means comprising a series of cooling headers longitudinally spaced from one another by means for providing passive air zones, the cooling headers being operable to apply a liquid cooling medium to the rail thereby to afford a relatively high rate of cooling of the rail as it passes each of the cooling headers, the means for providing passive air zones comprising shrouds of selected length immediately following the cooling headers close-coupled to the head portion of the rail forming gaps adjacent the head portion free of applied fluid thereby controlling the rate of cooling of the head portion of said rail to a relatively low figure as it passes through each of the means for providing air zones;

(b) means for minimizing the cooling of the web portion and the tips of the base portion of the rail during the intermittent forced cooling;

(c) transport means for passing the rail longitudinally along the series of cooling headers and air zones such that the head portion and base bottom portion of the rail may be subjected to the liquid cooling medium; and (d) control means for terminating the application of the liquid cooling medium when the head portion of the rail has reached a predetermined cooling stop temperature in the range 850° F. to 1200° F., the control means including temperature monitoring means at the entry and exit ends of the apparatus.

* * * * *

UNITED STATES PATENT AND TRADEMARK OFFICE

CERTIFICATE OF CORRECTION

PATENT NO. : 4,611,789

DATED : September 16, 1986

INVENTOR(S) : Robert J. Ackert et al.

It is certified that error appears in the above-identified patent and that said Letters Patent is hereby corrected as shown below:

Column 4, line 66, "tg" should be changed to --to--.

Column 5, line 63, "Ae3" should be changed to --$Ae_3$--.

Column 10, line 18, "portin" should be --portion--.

Column 10, line 21, "appliction" should be changed to --application--.

Column 10, line 22, "m edium" should be changed to --medium--

Column 10, line 23, "reaches" should be changed to --reached--.

Column 10, line 51, "n" should be changed to --in--.

Column 10, line 60, "te" should be changed to --the--.

Signed and Sealed this

Twentieth Day of January, 1987

*Attest:*

DONALD J. QUIGG

*Attesting Officer*

*Commissioner of Patents and Trademarks*